United States Patent [19]

Bailey

[11] Patent Number: 4,788,505

[45] Date of Patent: Nov. 29, 1988

[54] ADVANCE REFERENCE CYLINDER TRIGGER GENERATOR

[75] Inventor: Bill E. Bailey, Kent, Wash.

[73] Assignee: Pacific Northwest Electronics, Seattle, Wash.

[21] Appl. No.: 96,140

[22] Filed: Sep. 11, 1987

[51] Int. Cl.[4] ..... F02P 17/00

[52] U.S. Cl. ..... 324/379; 324/378

[58] Field of Search ..... 377/19, 20, 15; 73/116, 73/117.3; 324/379, 394, 384, 378, 380

[56] References Cited

U.S. PATENT DOCUMENTS

| | | | |
|---|---|---|---|
| 3,409,824 | 11/1968 | Makuh | 324/15 |
| 3,499,322 | 3/1970 | Pelta | 324/379 |
| 3,576,462 | 4/1971 | Wanninger | 315/22 |
| 3,990,302 | 11/1976 | Reeves et al. | 73/116 |
| 4,010,415 | 3/1977 | Reeves et al. | 324/16 S |
| 4,010,419 | 3/1977 | Reeves et al. | 324/16 S |
| 4,019,127 | 4/1977 | Cominskey et al. | 324/16 S |
| 4,063,152 | 12/1977 | Reeves | 324/16 T |
| 4,129,828 | 12/1978 | Jindrick | 324/16 S |
| 4,395,679 | 7/1983 | Gniewek | 324/379 |
| 4,742,306 | 5/1988 | Everett | 324/379 |

*Primary Examiner*—Reinhard J. Eisenzopf
*Assistant Examiner*—Jose M. Solis
*Attorney, Agent, or Firm*—Christensen, O'Connor, Johnson & Kindness

[57] ABSTRACT

An advance reference cylinder trigger generator that provides a more effective trigger signal to synchronize the horizontal sweep of a cathode ray tube based instrument used for troubleshooting, diagnosing and servicing of spark ignition internal combustion engines. The trigger pulses, $V_{pt}$, derived from the primary winding of an ignition coil are applied to a cylinder position counter (5) and, after being delayed by a delay circuit (4), to a cylinder count counter (8). When the value of cylinder position counter (5) equals or exceeds the value of cylinder count counter (8), an output from comparator (6) enables a monostable multivibrator (10) to produce an advance reference cylinder trigger $V_{at}$ upon receipt of the next ignition coil derived trigger pulse, $V_{pt}$. Because the $V_{pt}$ pulses lead spark plug discharge derived pulses, the $V_{pt}$ pulses lead the spark plug discharge pulse associated with the $V_{pt}$ pulse causing the firing of the monostable multivibrator.

16 Claims, 1 Drawing Sheet

ADVANCE REFERENCE CYLINDER TRIGGER GENERATOR

TECHNICAL AREA

This invention relates to signal generators and, more particularly, triggered sweep generators for use with cathode ray tube based instruments.

BACKGROUND OF THE INVENTION

The use of cathode ray tube based instruments, such as oscilloscopes, to analyze internal combustion engine performance, has become prevalent in recent years. The increased use of these instruments is in part due to the increasing complexity of the electronic portions of internal combustion engines and in part due to the increasing technical abilities of the persons performing the analyses. Uses for these instruments in analyzing internal combustion engines range from monitoring the timing of the electrical and mechanical functions of the engine relating to the coincidence of spark discharge and cylinder operation to measuring the multitude of electrical signals present in the modern internal combustion engine.

Proper use of an oscilloscope requires that the horizontal sweep be synchronized with the operation of the device being tested. With regard to internal combustion engines, current methods generally utilize an inductive device to pick up the spark discharge of a reference cylinder. When a spark discharge is detected, the inductive pick-up device produces a signal that triggers the horizontal sweep of the oscilloscope. This method of triggering the horizontal sweep of an oscilloscope has a major disadvantage. Specifically, during a horizontal sweep, an auto engine analyzer is designed to display signals derived from each cylinder in timed sequence on the oscilloscope. For example, a spark discharge signal for each cylinder generated during a cycle of engine operation may be displayed side by side. If the triggered sweep of the oscilloscope and the spark discharge of the reference cylinder occur at the same time, the reference cylinder spark discharge signal will not be properly displayed in relation to other cylinders of the engine under test. As a matter of fact, the beginning portion of the reference cylinder spark discharge signal may not be displayed at all.

As will be readily appreciated from the foregoing discussion, there is a need for a trigger generator for synchronizing the horizontal sweep of a cathode ray tube based instrument that will provide a more effective trigger signal than that derived from a reference cylinder spark discharge.

SUMMARY OF THE INVENTION

In accordance with this invention, an advance reference cylinder trigger generator is provided that is ideally suited for use with cathode ray tube based instruments for troubleshooting, diagnosing, and servicing of spark ignition internal combustion engines. The advance reference cylinder trigger generator includes two counters, both of which receive a pulse derived from the complex waveform signals created at the primary winding of the ignition coil of an internal combustion engine when spark plug discharges occur. One pulse is produced for each spark plug discharge since a complex waveform signal is created at the primary winding prior to each spark plug discharge. Depending upon the nature of the ignition system, primary winding complex waveform signals and spark discharges may be caused by opening breaker plate points or by opening a solid state switch. In any event, the counters are incremented each time a primary winding complex waveform signal occurs. One of the counters—a cylinder position counter—is incremented before the other counter—a cylinder count counter—is incremented. The cylinder count counter is reset by a pulse derived from the spark plug discharge of a reference cylinder. Immediately prior to being reset, the cylinder count counter value is stored in a latch. Hence, the latch value is equal to the number of cylinders of the internal combustion engine producing the spark plug discharge signals. The latch value is compared with the count value of the cylinder position counter. When a comparison occurs, indicating the next cylinder will be the reference, a monostable multivibrator is enabled to produce a sweep trigger pulse with the occurrence of the next primary signal. Since the complex primary winding ignition coil waveform signals lead the cylinder spark plug discharge signals, the trigger pulse is produced in advance of the reference spark plug discharge signal, which occurs shortly after the primary waveform triggers the enabled monostable multivibrator.

In accordance with other aspects of this invention, the reference spark plug discharge derived signal and the advance reference cylinder trigger pulse signal are OR gated together so that the earliest of the signals can be used to trigger the horizontal sweep of an oscilloscope incorporating the invention. As a result, the reference cylinder spark plug discharge derived signal will trigger the oscilloscope in the absence of an advance reference cylinder trigger pulse signal.

Because an advance reference cylinder trigger pulse produced by an advance reference cylinder trigger generator formed in accordance with the invention leads the related reference cylinder spark plug discharge derived signal, the reference cylinder spark plug discharge signal is accurately and completely displayed with the other cylinder spark plug.

DESCRIPTION OF THE PREFERRED EMBODIMENT

Figure 1:
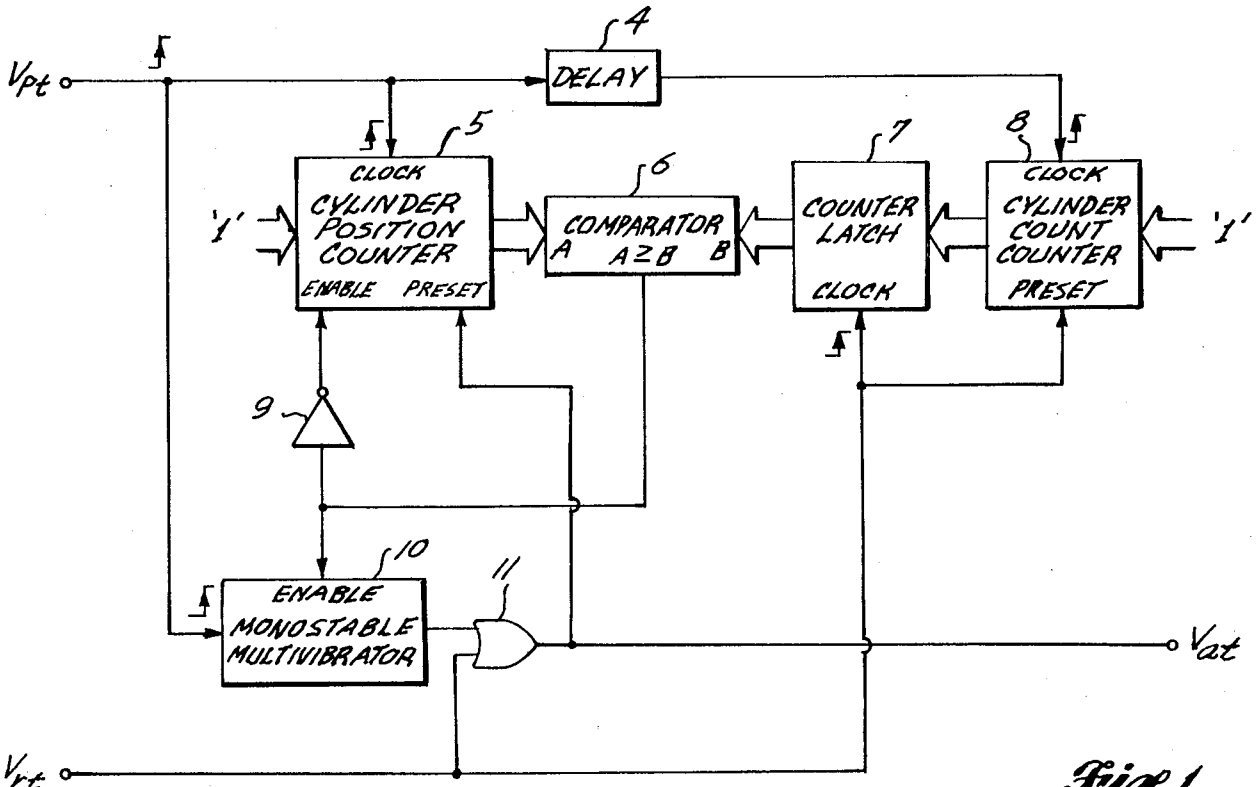
FIG. 1 shows an advance reference cylinder trigger generator formed in accordance with this invention.

As illustrated in the accompanying drawing, the preferred embodiment of an advance reference cylinder trigger generator formed in accordance with this invention comprises: a delay circuit 4; two digital counters designated a cylinder position counter 5 and a cylinder count counter 8; a counter latch 7; a comparator 6; an inverter 9; a two-input OR gate 11; and, a monostable multivibrator 10.

An ignition coil primary trigger pulse signal, designated $V_{pt}$, derived from the primary winding of the ignition coil of an internal combustion engine and a reference cylinder spark plug discharge pulse signal, denoted $V_{rt}$, derived from the spark plug wire running to the reference cylinder of the internal combustion engine, are both applied to the advance reference cylinder trigger generator illustrated in the drawing. $V_{pt}$ pulses are applied to the clock (clock) input of the cylinder position counter 5 and through delay circuit 4 to the clock (clock) input of the cylinder count counter 8. While various delays can be used, in one actual embodiment of the invention, the delay circuit 4 delayed the application of $V_{pt}$ pulses to the cylinder count counter 8 by one millisecond. $V_{pt}$ pulses are also applied to the trigger input of the monostable multivibrator 10.

$V_{rt}$ pulses are applied to one input of the OR gate 11, to the clock input of the counter latch 7 and to the preset input of the cylinder count counter 8. The cylinder count counter 8 is connected to be set to a decimal 1 (binary 0001) state when a reference cylinder discharge pulse, i.e., a $V_{rt}$ pulse, is applied to the preset input of the cylinder count counter 8. The data output of the cylinder count counter 8 is applied to the data input of the counter latch 7 and the data output of the counter latch 7 is applied to one of the data inputs of the comparator 6, denoted the B data input. In a conventional manner, the counter latch 7 reads and stores the data output of the cylinder count counter 8 on the leading edge of each $V_{rt}$ pulse.

The comparison output of the comparator 6 is applied to the enable input of the monostable multivibrator 10 and through the inverter 9 to the enable input of the cylinder position counter 5. The output of the monostable multivibrator 10 is connected to the second input of the OR gate 11. The output of the OR gate is applied to the preset input of the cylinder position counter 5. The cylinder position counter 5 is connected to be set to a decimal 1 (binary 0001) state when a pulse occurs on the output of the OR gate 11. The output of the OR gate 11, which is denoted $V_{at}$, also forms the advance reference cylinder trigger output of the advance reference cylinder trigger generator.

As noted above, the $V_{pt}$ pulses are derived from the primary winding of the ignition coil of an internal combustion engine. One $V_{pt}$ pulse occurs for each complex fluctuation of the primary winding that occurs when an internal combustion engine cylinder is fired. The $V_{rt}$ pulses are derived from the spark plug wire of the reference cylinder of the internal combustion engine. Since one $V_{rt}$ pulse is produced for each reference cylinder firing, the number of $V_{pt}$ pulses equals the number of $V_{rt}$ pulses times the number of cylinders in the engine. Since the cylinder count counter 8 is preset to one each time a $V_{rt}$ pulse occurs, the pulse count of the cylinder count counter 8 that is latched into the counter latch 7 prior to the cylinder count counter 8 being reset equals the number of cylinders of the engine. The value is continuously compared in the comparator 6 with the counted $V_{pt}$ pulses. When the counted $V_{pt}$ pulses from the cylinder position counter 5 equal the value latched in the counter latch 7, the monostable multivibrator 10 is enabled such that the arrival of the next $V_{pt}$ pulse will cause an output, which corresponds to the $V_{pt}$ pulse associated with the reference cylinder. Since a $V_{pt}$ pulse corresponding to a $V_{rt}$ pulse leads the $V_{rt}$ pulse, by virtue of the fact that the primary winding fluctuations caused by point or solid state switch opening occurs before a related spark plug discharge, the output of the monostable multivibrator 10 is a pulse in advance of the actual spark discharge of the reference cylinder. As a result, the monostable multivibrator 10 produces a $V_{at}$ pulse useful to trigger the horizontal sweep of an oscilloscope before a $V_{rt}$ pulse is passed by the OR gate 11. Thus, the multivibrator pulses, $V_{at}$, lead, or are in advance of, the reference cylinder pulses, $V_{rt}$. In the absence of a multivibrator pulse, $V_{at}$ pulses are formed by $V_{rt}$ pulses. $V_{at}$ pulses could be formed by $V_{rt}$ pulses rather than multivibrator pulses if $V_{pt}$ pulses are not generated by virtue of a related test lead not being applied in the primary winding of the ignition coil of an internal combustion engine. In this case, the horizontal sweep of the oscilloscope would not be advance triggered.

In accordance with the invention, the $V_{rt}$ pulse duration must be longer than the delay of the delay circuit 4 to prevent the cylinder count counter 8 from being incremented by the delayed $V_{pt}$ pulse associated with the reference cylinder. If this is not done, the cylinder count counter 8 will count one more pulse than the number of cylinders due to the one preset. If this is done, the cylinder count counter 8, which will be incremented by each successive $V_{pt}$ pulse, will count up to the number of cylinders and the counter latch 7 will store a binary count value equalling the number of cylinders of the engine under test.

While a preferred embodiment of the invention has been illustrated and described herein, it will be appreciated that, within the scope of the appended claims, various changes can be made therein. Hence, the invention can be practiced otherwise than as specifically described herein.

The embodiments of the invention in which an exclusive property or privilege is claimed are defined as follows:

1. An advance reference cylinder trigger generator suitable for use in a cathode ray tube based internal combustion engine analyzer, said advance reference cylinder trigger generator comprising:

(a) a cylinder position counter for receiving pulses derived from the complex waveform signals created at the primary winding of the coil of an internal combustion engine when coil energy is dissipated to create a spark discharge and producing a related cylinder position count value;

(b) a cylinder count counter for receiving said pulses derived from the complex waveform signals created at the primary winding of the coil of an internal combustion engine when coil energy is dissipated to create a spark discharge and producing a related number of cylinders count value;

(c) a latch connected to said cylinder count counter for receiving and storing said number of cylinders count value;

(d) a comparator connected to said cylinder position counter and said latch for receiving and comparing said cylinder position count value to said number of cylinders count value stored by said latch and providing an enable signal when said cylinder position count value matches said number of cylinders count value; and, (e) a trigger pulse generator connected to said comparator for receiving said enable signal and generating a trigger pulse.

2. The advance reference cylinder trigger generator claimed in claim 1, wherein said trigger pulse generator also receives said pulses derived from the complex waveform signals created at the primary winding of the coil of an internal combustion engine when coil energy is dissipated to create a spark discharge and generates said trigger pulse upon the occurrence of the next derived pulse following the receipt of an enable signal produced by said comparator.

3. The advance reference cylinder trigger generator claimed in claim 2, wherein said cylinder position counter and said cylinder count counter are reset by pulses derived from the spark discharge signal produced when the reference cylinder of the internal combustion engine creating said complex waveform signals is fired.

4. The advance reference cylinder trigger generator claimed in claim 3, including a delay circuit for delaying the application of said pulses derived from the complex waveform signals created at the primary winding of the coil of an internal combustion engine when the coil energy is dissipated to create a spark discharge to said cylinder count counter.

5. The advance reference cylinder trigger generator claimed in claim 4, wherein the delay created by said delay circuit is less than the pulse width of said pulses derived from the spark discharge signal produced when the reference cylinder of the internal combustion engine creating said complex waveform signals is fired thereby preventing said cylinder count counter from incrementing upon receipt of the delayed cylinders count value associated with the reference cylinder from said delay means.

6. The advance reference cylinder trigger generator claimed in claim 4, wherein said pulses derived from the spark discharge signal produced when the reference cylinder of the internal combustion engine creating said complex waveform signals is fired are applied to the clock input of said latching means.

7. The advance reference cylinder trigger generator claimed in claim 6, wherein said cylinder count counter is presettable to a binary one (1) state and wherein said pulse derived from the spark discharge signal produced when the reference cylinder of the internal combustion engine creating said complex waveform signals is fired is also applied to the preset input of said cylinder count counter.

8. The advance reference cylinder trigger generator claimed in claim 7, wherein said trigger pulse generator is a monostable multivibrator.

9. The advance reference cylinder trigger generator claimed in claim 8, wherein said cylinder position counter is presettable to a binary one (1) state and wherein said trigger pulses are applied to the preset input of said cylinder position counter.

10. The advance reference cylinder trigger generator claimed in claim 9, including a two-input OR gate, one input of said OR gate connected to the output of said monostable multivibrator to receive said trigger pulses and the other input of said OR gate connected to receive said pulses derived from the spark discharge signal produced when the reference cylinder of the internal combustion engine creating said complex waveform signals is fired.

11. The advance reference cylinder trigger generator claimed in claim 2, wherein said trigger pulse generator is a monostable multivibrator.

12. The advance reference cylinder trigger generator claimed in claim 1, including a delay circuit for delaying the application of said pulses derived from the complex waveform signals created at the primary winding of the coil of an internal combustion engine when the coil energy is dissipated to create a spark discharge to said cylinder count counter.

13. The advance reference cylinder trigger generator as claimed in claim 1, wherein said cylinder position counter and said cylinder count counter are reset by pulses derived from the spark discharge signal produced when the reference cylinder of the internal combustion engine creating said complex waveform signals is fired.

14. The advance reference cylinder trigger generator claimed in claim 13, wherein said pulses derived from the spark discharge signal produced when the reference cylinder of the internal combustion engine creating said complex waveform signals is fired and applied to the clock input of said latch.

15. The advance reference cylinder trigger generator claimed in claim 14, wherein said cylinder count counter is presettable to a binary one (1) state and wherein said pulse derived from the spark discharge signal produced when the reference cylinder of the internal combustion engine creating said complex waveform signals is fired is also applied to the preset input of said cylinder count counter.

16. The advance reference cylinder trigger generator claimed in claim 15, wherein said cylinder position counter is presettable to a binary one (1) state and wherein said trigger pulses are applied to the preset input of said cylinder position counter.

* * * * *